US009008532B2

(12) United States Patent
Kataoka

(10) Patent No.: US 9,008,532 B2
(45) Date of Patent: Apr. 14, 2015

(54) IMAGE PROCESSING APPARATUS OPERABLE BY AC POWER AND DC POWER, METHOD OF CONTROLLING THE APPARATUS, AND STORAGE MEDIUM

(71) Applicant: Canon Kabushiki Kaisha, Tokyo (JP)

(72) Inventor: Junnosuke Kataoka, Yokohama (JP)

(73) Assignee: Canon Kabushiki Kaisha (JP)

( * ) Notice: Subject to any disclaimer, the term of this patent is extended or adjusted under 35 U.S.C. 154(b) by 150 days.

(21) Appl. No.: 13/778,319

(22) Filed: Feb. 27, 2013

(65) Prior Publication Data

US 2013/0236205 A1 Sep. 12, 2013

(30) Foreign Application Priority Data

Mar. 7, 2012 (JP) ..... 2012-050281

(51) Int. Cl.
*G03G 15/00* (2006.01)
*G03G 15/20* (2006.01)

(52) U.S. Cl.
CPC ..... *G03G 15/80* (2013.01); *G03G 15/2039* (2013.01)

(58) Field of Classification Search
CPC ..... G03G 15/2039; G03G 15/80
USPC ..... 399/88, 89, 90
See application file for complete search history.

(56) References Cited

U.S. PATENT DOCUMENTS 8,611,777 B2 * 12/2013 Yoon et al. ..... 399/88
2004/0022550 A1 * 2/2004 Okada ..... 399/88
2007/0071479 A1 * 3/2007 Semma et al. ..... 399/88

FOREIGN PATENT DOCUMENTS

JP 2011-061974 A 3/2011

* cited by examiner

*Primary Examiner* — Susan Lee
(74) *Attorney, Agent, or Firm* — Rossi, Kimms & McDowell LLP

(57) ABSTRACT

An image processing apparatus that is operable by AC power and DC power. The image processing apparatus includes a fixing heater section for heating a recording sheet having toner transferred thereon so as to fuse the toner onto the sheet and a plurality of electronic circuits. An AC power supply circuit section receives AC power from an AC power supply line. A DC power supply circuit section receives DC power from a DC power supply line. A power supply unit supplies the AC power received by the AC power supply circuit section to the fixing heater section, and the DC power received by the DC power supply circuit section to the plurality of electronic circuits.

10 Claims, 7 Drawing Sheets

IMAGE PROCESSING APPARATUS OPERABLE BY AC POWER AND DC POWER, METHOD OF CONTROLLING THE APPARATUS, AND STORAGE MEDIUM

BACKGROUND OF THE INVENTION

1. Field of the Invention

The present invention relates to an image processing apparatus, a method of controlling the same, and a storage medium.

2. Description of the Related Art

Recently, on fears of world-wide shortage of energy resources, utilization of natural energy has been rapidly pursued. One of the most potential natural energy resources is solar cells. Power generated by solar cells is DC power, and a storage battery for storing the power is also a DC battery. Further, many of electrical appliances are driven by DC power obtained by converting commercial AC power. If DC power generated e.g. by solar cells is used without being converted to AC power, power usage efficiency can be enhanced.

For this reason, a home hybrid power system that supplies power using two systems, i.e. a direct current (DC) system and an alternating current (AC) system, is under development. In the development of such an AC/DC hybrid power supply system, it is envisaged that electrical appliances which can be used at low voltages are supplied with power by the DC system, and a refrigerator and the like which need high voltages are supplied with power by the AC system.

For nighttime DC power supply, the AC/DC hybrid power supply system is provided with a storage battery that is charged with power during daytime and an AC-to-DC converter that converts AC power to DC power. Further, some AC/DC hybrid power supply systems are provided with a DC-to-AC converter that converts DC power to AC power for selling power.

In connection with the above-mentioned technique, there has been disclosed a power management method for an image processing apparatus using USB supply power and a battery (see e.g. Japanese Patent Laid-Open Publication No. 2011-061974).

According to the disclosed method, DC power is generated from commercial AC power and USB supply power and is supplied to each of components requiring power. Further, the DC power is used to charge a built-in rechargeable secondary battery. The voltage of each power supply is detected, and when it is judged, based on an operation mode of a copying machine and a result of the voltage detection, that sufficient power cannot be supplied from the USB supply power alone, power from the recharged secondary battery is supplementarily supplied.

Since the USB supply power is DC power, Japanese Patent Laid-Open Publication No. 2011-061974 proposes the image processing apparatus that is operated using a commercial AC power supply and a DC power supply as power supply sources.

However, to supply power from the secondary battery to a component which requires a large amount of power, such as a fixing section of an image forming apparatus, by the method proposed in Japanese Patent Laid-Open Publication No. 2011-061974, the secondary battery is required to have a very large capacity and hence is very expensive.

On the other hand, in the AC/DC hybrid power supply system, although the commercial AC power supply is capable of supplying a large amount of power and is stable, the DC power supply is not capable of supplying a large amount of power and is low in stability.

SUMMARY OF THE INVENTION

The present invention provides an image processing apparatus operable by AC power and DC power, a method of controlling the image processing apparatus, and a storage medium.

In a first aspect of the present invention, there is provided a image processing apparatus including a heating unit for heating a recording sheet having toner transferred thereon so as to fuse the toner onto the sheet, and a plurality of electronic circuits, comprising an AC power receiving unit configured to receive AC power from an AC power supply, a DC power receiving unit configured to receive DC power from a DC power supply, and a supply unit configured to supply the AC power received by the AC power receiving unit to the heating unit, and the DC power received by the DC power receiving unit to the plurality of electronic circuits.

In a second aspect of the present invention, there is provided a method of controlling an image processing apparatus including a heating unit for heating a recording sheet having toner transferred thereon so as to fuse the toner onto the sheet, and a plurality of electronic circuits, comprising receiving AC power from an AC power supply, receiving DC power from a DC power supply, and supplying the AC power received from the AC power supply to the heating unit and the DC power received from the DC power supply to the plurality of electronic circuits.

In a third aspect of the present invention, there is provided a non-transitory computer-readable storage medium storing a computer-executable program for causing a computer to execute a method of controlling an image processing apparatus including a heating unit for heating a recording sheet having toner transferred thereon so as to fuse the toner onto the sheet, and a plurality of electronic circuits, wherein the method comprises receiving AC power from an AC power supply, receiving DC power from a DC power supply, and supplying the AC power received from the AC power supply to the heating unit and the DC power received from the DC power supply to the plurality of electronic circuits.

According to the present invention, it is possible to provide an image processing apparatus operable by AC power and DC power, a method of controlling the image processing apparatus, and a storage medium.

Further features of the present invention will become apparent from the following description of exemplary embodiments with reference to the attached drawings.

DESCRIPTION OF THE EMBODIMENTS

The present invention will now be described in detail below with reference to the accompanying drawings showing an embodiment thereof.

Figure 1:
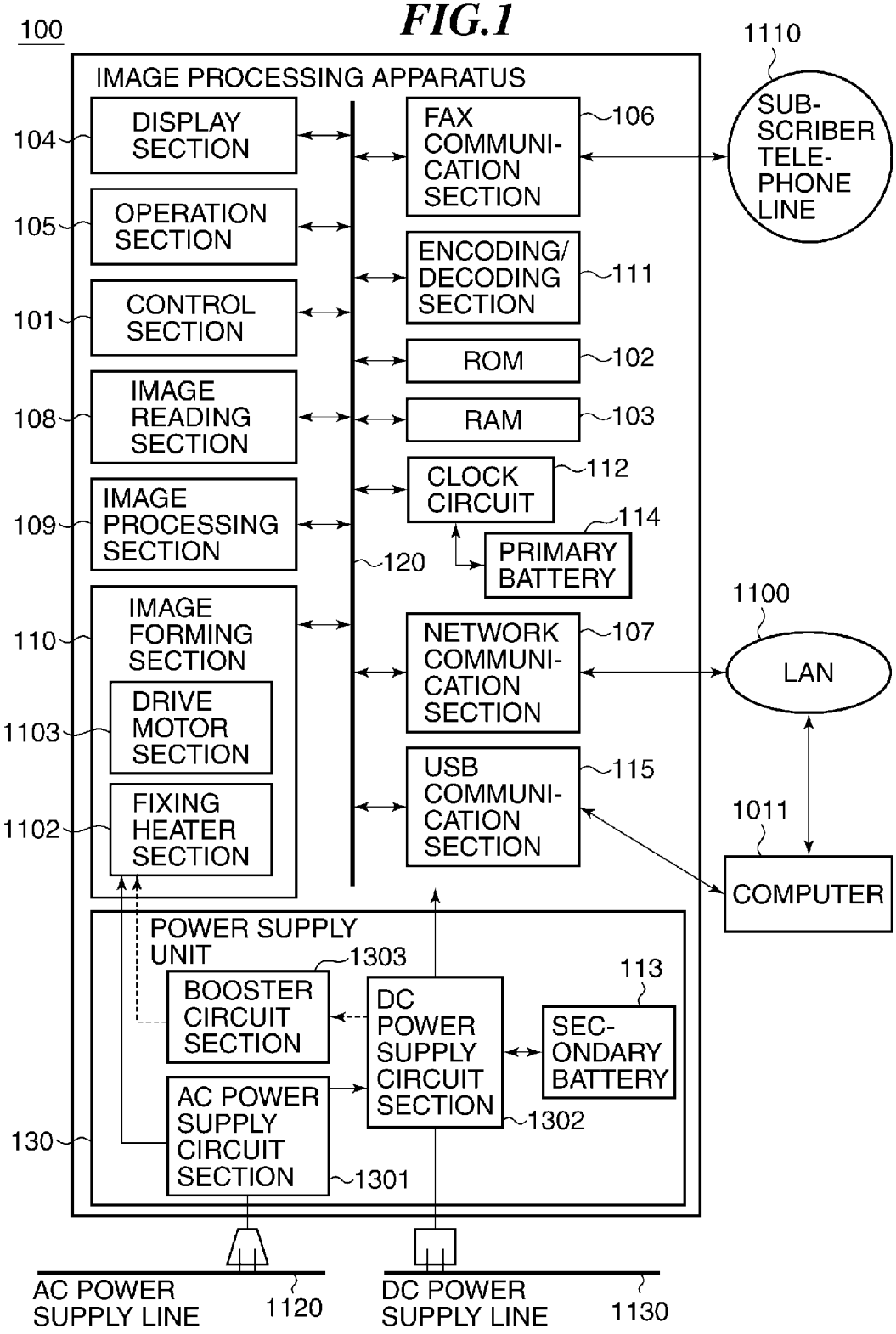
FIG. 1 is a schematic diagram of the configuration of an image processing apparatus according to an embodiment of the present invention.

FIG. 1 is a schematic diagram of the configuration of an image processing apparatus 100 according to the embodiment of the present invention.

Referring to FIG. 1, a control section 101 includes a CPU and controls the overall operation of the image processing apparatus 100. A ROM 102 stores programs to be executed by the control section 101 and various kinds of data. The programs to be executed by the control section 101 are loaded in a RAM 103 under the control of the control section 101. Further, the RAM 103 is used as a work area of the control section 101, and stores images to be used by the copying function or the facsimile function.

A clock circuit 112 is configured to output time information. The clock circuit 112 is driven by a primary battery 114.

An operation section 105 comprises various kinds of keys for use by a user to operate the image processing apparatus 100. A display section 104 displays various kinds of information for use in operating the image processing apparatus 100.

A FAX communication section 106 performs FAX communication via a subscriber telephone line 1110 which is an analog telephone line. The FAX communication section 106 has a memory reception function for temporarily storing received image data in the RAM 103 without immediately outputting the image data onto a recording sheet, and then outputting the same onto the recording sheet.

Further, the FAX communication section 106 has a timer transmission function for temporarily storing image data for transmission in the RAM 103 without immediately transmitting the image data, and then transmitting the same at a set time. Note that even when the power of the image processing apparatus 100 is turned off, image data stored in the RAM 103 before transmission is held therein for a predetermined time period by a battery backup function.

An image reading section 108 is an original reading section that reads an original. An image processing section 109 performs conversion of a read image or image data to be output. An image forming section 110 includes a drive motor section 1103 and a fixing heater section 1102, and outputs image data onto a recording sheet. The image forming section 110 in the present embodiment transfers toner onto a recording sheet according to image data to thereby output the image data onto the recording sheet. In a copying operation, the image forming section 110 outputs image data read by the image reading section 108 onto a recording sheet, while in a printing operation, the image forming section 110 outputs image data received e.g. from a computer 1011 onto a recording sheet. The fixing heater section 1102 heats a recording sheet so as to fuse toner transferred thereon. The drive motor section 1103 drives a photosensitive drum, not shown, and so forth.

A network communication section 107 receives image data transferred from the computer 1011 for being output onto a recording sheet, via a LAN 1100, or transmits image data read by the image reading section 108 to the computer 1011, via the LAN 1100. The network communication section 107 is also used for a remote user interface function for operating the image processing apparatus 100 through HTTP connection from the computer 1011 via a browser.

An encoding/decoding section 111 encodes image data read by the image reading section 108 before the image data is transmitted by the FAX communication section 106. Further, the encoding/decoding section 111 decodes image data received by the FAX communication section 106 before the image data is output onto a recording sheet.

Furthermore, the encoding/decoding section 111 encodes image information of a plurality of pages before execution of a copying operation so as to temporarily store the image information or decodes encoded image data before the image data is output onto a recording sheet.

A CPU bus 120 interconnects a plurality of electronic circuits. The electronic circuits mentioned here are the control section 101, the ROM 102, the RAM 103, the operation section 105, the display section 104, the FAX communication section 106, the network communication section 107, the image reading section 108, the image processing section 109, the image forming section 110, and the encoding/decoding section 111.

The CPU bus 120 is a name collectively referring to an address bus for transferring an address signal, a control bus for transferring a control signal, and a data bus for transferring various kinds of data.

A USB communication section 115 receives image data transferred from the computer 1011 for being output onto a recording sheet, via a USB cable, or transmits image data read by the image reading section 108 to the computer 1011, via the USB cable.

The USB communication section 115 also has a function for receiving VBUS power from the computer 1011 for supply to the image processing apparatus 100.

A power supply unit 130 includes a DC power supply circuit section 1302 as a DC power receiving unit for receiving DC power from a DC power supply (DC power supply line 1130). The DC power supply circuit section 1302 converts AC power supplied from an AC power supply line 1120 to DC power and supplies the DC power to each of the sections. Note that the sections mentioned here are the control section 101, the ROM 102, the RAM 103, the operation section 105, the display section 104, the FAX communication section 106, the network communication section 107, the image reading section 108, the image processing section 109, the USB communication section 115, the drive motor section 1103, and the encoding/decoding section 111.

Further, the DC power supply circuit section 1302 converts power supplied from the DC power supply line 1130 to a voltage required by the image processing apparatus 100. The DC power supply circuit section 1302 is connected to a secondary battery 113 (power storage unit) capable of storing power, and when the supply of DC power becomes insufficient, the DC power supply circuit section 1302 discharges power from the secondary battery 113 to thereby compensate for the shortage of DC power.

The power supply unit 130 includes an AC power supply circuit section 1301 as an AC power receiving unit for receiving AC power from the AC power supply (AC power supply line 1120). The AC power supply circuit section 1301 supplies power supplied from the AC power supply line 1120 to the fixing heater section 1102. The AC power supply circuit section 1301 also converts power supplied from the AC power supply line 1120 into DC power and supplies the DC power to the the image processing apparatus 100. In the following, the conversion by the AC power supply circuit section 1301, i.e. conversion of AC power supplied from the AC power supply line 1120 to DC power and further conversion of the DC power to a voltage required by the image processing apparatus 100 will be simply referred to as AC-to-DC conversion.

A booster circuit section 1303 boosts DC power supplied from the DC power supply circuit section 1302 and supplies the boosted DC power to the fixing heater section 1102 of the image processing apparatus 100 in place of AC power.

The power supply unit 130 (supply unit) is provided with supplied power detection sections, not shown, and a power switching section, not shown. The supplied power detection sections detect respective states of supply of power from the AC power supply line 1120 and the DC power supply line 1130. The power switching section switches between the supply sources of power. Thus, the power supply unit 130 supplies at least one of AC power received by the AC power supply circuit section 1301 and DC power received by the DC power supply circuit section 1302, as power for the fixing heater section 1102 and the electronic circuits.

Figure 2:
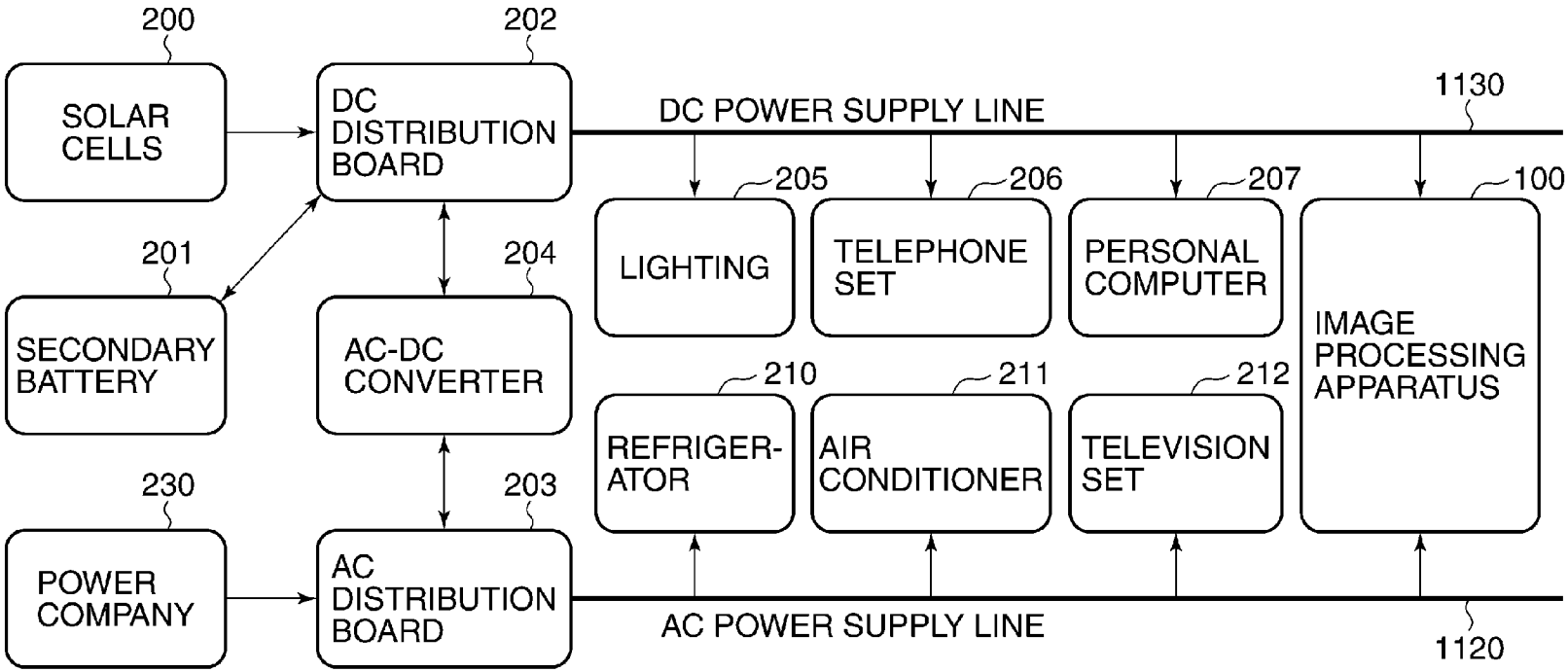
FIG. 2 is a diagram of a power distribution environment of an office or a home where the image processing apparatus shown in FIG. 1 is installed.

FIG. 2 is a diagram of a power distribution environment of an office or a home where the image processing apparatus 100 shown in FIG. 1 is installed.

Referring to FIG. 2, commercial AC power supplied from a power company 230 is supplied to an AC distribution board 203, and is supplied from the AC distribution board 203 to electrical apparatuses through the AC power line 1120. On the other hand, DC power generated by solar cells 200 is delivered to a DC distribution board 202, and is supplied to electrical apparatuses through the DC power supply line 1130.

A secondary battery 201 is connected to the DC distribution board 202, and when there is a surplus of DC power generated by the solar cells 200, the secondary battery 201 is charged with the surplus DC power. On the other hand, when DC power generated by the solar cells 200 is insufficient, the supply of DC power to the DC power supply line 1130 is stabilized by using the power from the secondary battery 201.

An AC-DC converter 204 is connected between the AC distribution board 203 and the DC distribution board 202. When sufficient DC power cannot be supplied to the DC power supply line 1130 due to shortage of power generated by the solar cells 200 and an insufficient charge amount of the secondary battery 201, the AC-DC converter 204 generates DC power from AC power and supplies the DC power to the DC distribution board 202.

When no power is supplied from the commercial AC power supply due to power failure, the AC-DC converter 204 generates AC power from DC power and supplies the AC power to the AC distribution board 203. Connected to the AC power supply line 1120 are electrical apparatuses, such as a refrigerator 210, an air conditioner 211, and a television set 212, which are operated by AC power. Connected to the DC power supply line 1130 are electrical apparatuses, such as lighting 205, a telephone set 206, and a personal computer 207, which are operated by DC power.

The image processing apparatus 100 is supplied with power from both the AC power supply line 1120 and the DC power supply line 1130.

Figure 3:
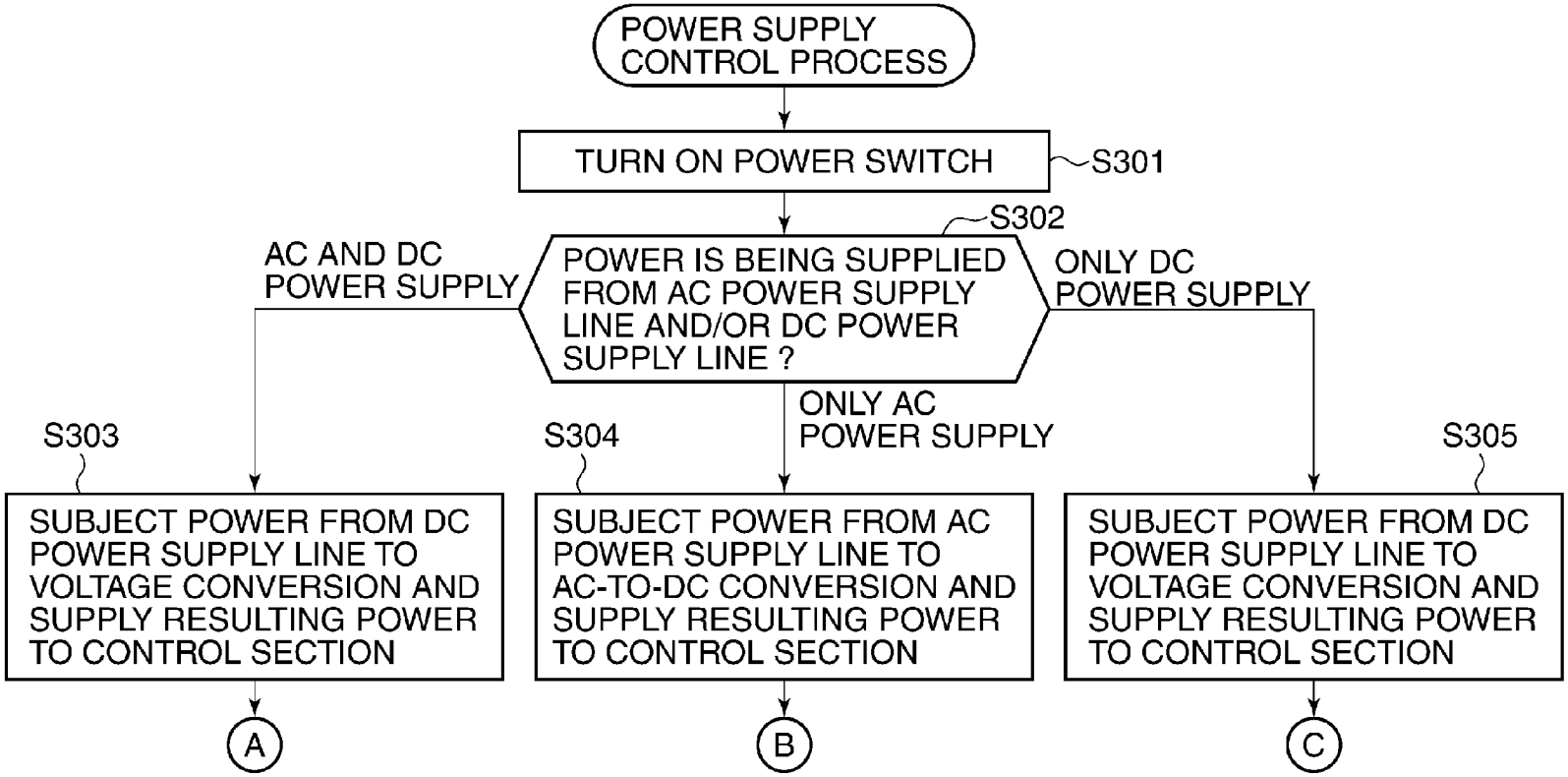
FIG. 3 is a flowchart of a power supply control process executed by a power supply unit appearing in FIG. 1.

FIG. 3 is a flowchart of a power supply control process executed by the power supply unit 130 appearing in FIG. 1.

The power supply control process is realized by a logical circuit, not shown, of the power supply unit 130. The above-mentioned supplied power detection sections for detecting the respective states of supply of power from the AC power supply line 1120 and the DC power supply line 1130 are provided in the AC power supply circuit section 1301 and the DC power supply circuit section 1302, respectively.

First, when the power switch of the image processing apparatus 100 is turned on (step S301), it is determined through detection by the supplied power detection sections whether or not power is being supplied from the AC power supply line 1120 and/or the DC power supply line 1130 (step S302). Here, it is assumed that power is being supplied from at least one of the AC power supply line 1120 and the DC power supply line 1130.

If it is determined in the step S302 that power is being supplied from both the AC power supply line 1120 and the DC power supply line 1130 (AC and DC power supply in the step S302), power supplied from the DC power supply line 1130 is subjected to voltage conversion and then supplied to the control section 101 (step S303), and then the process proceeds to a process (A) which will be described with reference to FIG. 4.

If it is determined in the step S302 that power is being supplied from the AC power supply line 1120 alone (only AC power supply in the step S302), power supplied from the AC power supply line 1120 is subjected to AC-to-DC conversion and then supplied to the control section 101 (step S304), and then the process proceeds to a process (B) which will be described with reference to FIG. 5.

If it is determined in the step S302 that power is being supplied from the DC power supply line 1130 alone (only DC power supply in the step S302), power supplied from the DC power supply line 1130 is subjected to voltage conversion and supplied to the control section 101 (step S305), and the process proceeds to a process (C) which will be described with reference to FIG. 6.

In the above-described power supply control process, each of the processes (A), (B), and (C) following the process in FIG. 3 is executed by the control section 101 according to a program stored in the ROM 102.

Figure 4:
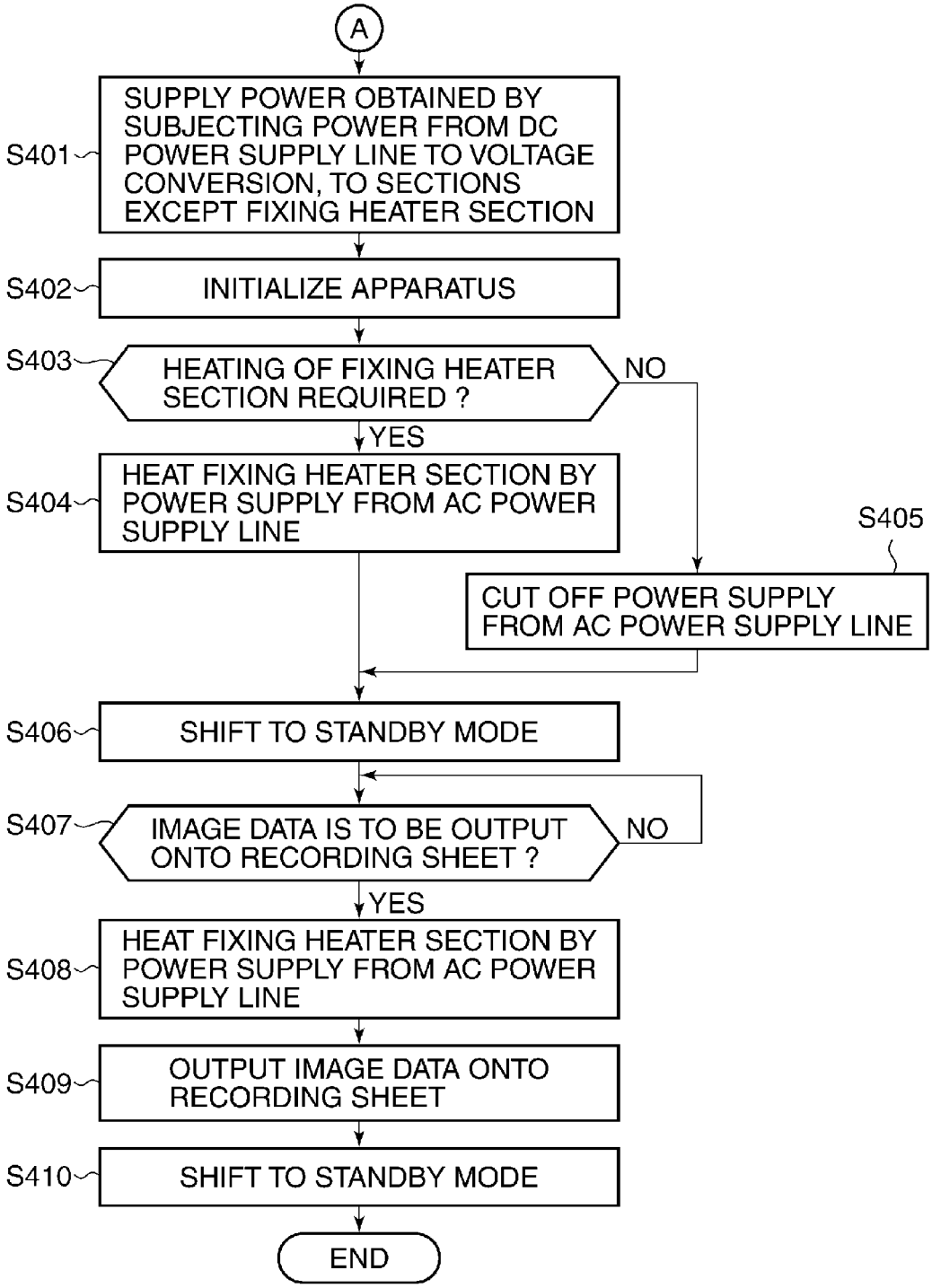
FIG. 4 is a continuation (A) of FIG. 3.

FIG. 4 is a continuation of FIG. 3, i.e. a flowchart of the power supply control process (A) executed by the control section 101 appearing in FIG. 1.

The power supply control process (A) shown in FIG. 4 is a process following the step S303 in FIG. 3, and corresponds to a case where power supply from the DC power supply line 1130 is given higher priority than power supply from the AC power supply line 1120.

First, power obtained by voltage-conversion of power supplied from the DC power supply line 1130 is supplied to each of the sections except the fixing heater section 1102 (step S401). See the description given with reference to FIG. 1, for these sections.

Next, the image processing apparatus 100 is initialized (step S402). Then, it is determined whether or not it is required to heat the fixing heater section 1102 (step S403). The answer to the question of this step becomes affirmative (YES) when the current temperature of the fixing heater section 1102 is lower than a predetermined temperature. Otherwise, the answer to the question becomes negative (NO).

If it is determined in the step S403 that it is not required to heat the fixing heater section 1102 (NO to the step S403), supply of power from the AC power supply line 1120 is cut off (step S405), and the process proceeds to a step S406.

On the other hand, if it is determined in the step S403 that it is required to heat the fixing heater section 1102 (YES to the step S403), the fixing heater section 1102 is heated up to the predetermined temperature by power supplied from the AC power supply line 1120 (step S404). Then, the supply of power from the AC power supply line 1120 for heating is cut off, and the image processing apparatus 100 shifts to a standby mode (step S406).

Then, when image data is to be output onto a recording sheet (YES to a step S407), the fixing heater section 1102 is heated by power supplied from the AC power supply line 1120 (step S408). As a case where image data is output onto a recording sheet, there may be mentioned a copying operation, a printing operation, or a FAX reception, as described hereinabove.

Then, the image data is output onto the recording sheet (step S409), and the supply of power from the AC power supply line 1120 for heating is cut off. Thereafter, the image processing apparatus 100 shifts to the standby mode (step S410), followed by terminating the present process.

Now, why power supply from the DC power supply line 1130 is given higher priority than power supply from the AC power supply line 1120 in the FIG. 4 power supply control process will be explained. The image processing apparatus 100 basically uses DC power. Further, even when the conversion efficiency of converting AC power to DC power is assumed to be 80%, the loss of power is large.

Therefore, assuming that energy efficiency of AC power supplied from the AC power supply line 1120 is the same as that of DC power supplied from the DC power supply line 1130, energy consumption efficiency with respect to the environment is better when DC power supplied from the DC power supply line 1130 is used.

Further, the reason why power supplied from the AC power supply line 1120 is used to heat the fixing heater section 1102 in the step S404 is that the amount of power consumed for heating of the fixing heater section 1102 is large.

The voltage of DC power supplied from the DC power supply line 1130 is within a range of 12V to 24V, i.e. low, and the amount of current that can be supplied from the DC power supply line 1130 is relatively small, so that when the DC power is used, it takes longer to heat the fixing heater section 1102 than when power supplied from the AC power supply line 1120 is used.

Heating of the fixing heater section 1102 in the standby mode has the meaning of preheating. To quickly output image data onto a recording sheet when it is required to do so, preheating is necessary, but when it is not required to quickly output image data, preheating is unnecessary.

According to the FIG. 4 process, in a case where AC power is being received by the AC power supply circuit section 1301 and DC power by the DC power supply circuit section 1302, the power supply unit 130 supplies power as follows: The power supply unit 130 supplies AC power received by the AC power supply circuit section 1301 to the fixing heater section 1102, and supplies DC power received by the DC power supply circuit section 1302 to the electronic circuits. This makes it possible to provide an image processing apparatus operable by AC power and DC power. Further, since AC power is used for the fixing heater section 1102 and the like suitable for use of AC power and DC power is used for the electronic circuits and the like operable by low-voltage DC power, it is possible to effectively reduce power consumption. In short, it is possible to provide an image processing apparatus which is operable by AC power and DC power and capable of effectively reducing power consumption.

Further, heating by the fixing heater section 1102 is not performed in the steps S403 and S405, and in this case, the power supply unit 130 does not supply AC power received by the AC power supply circuit section 1301 to the fixing heater section 1102.

Figure 5:
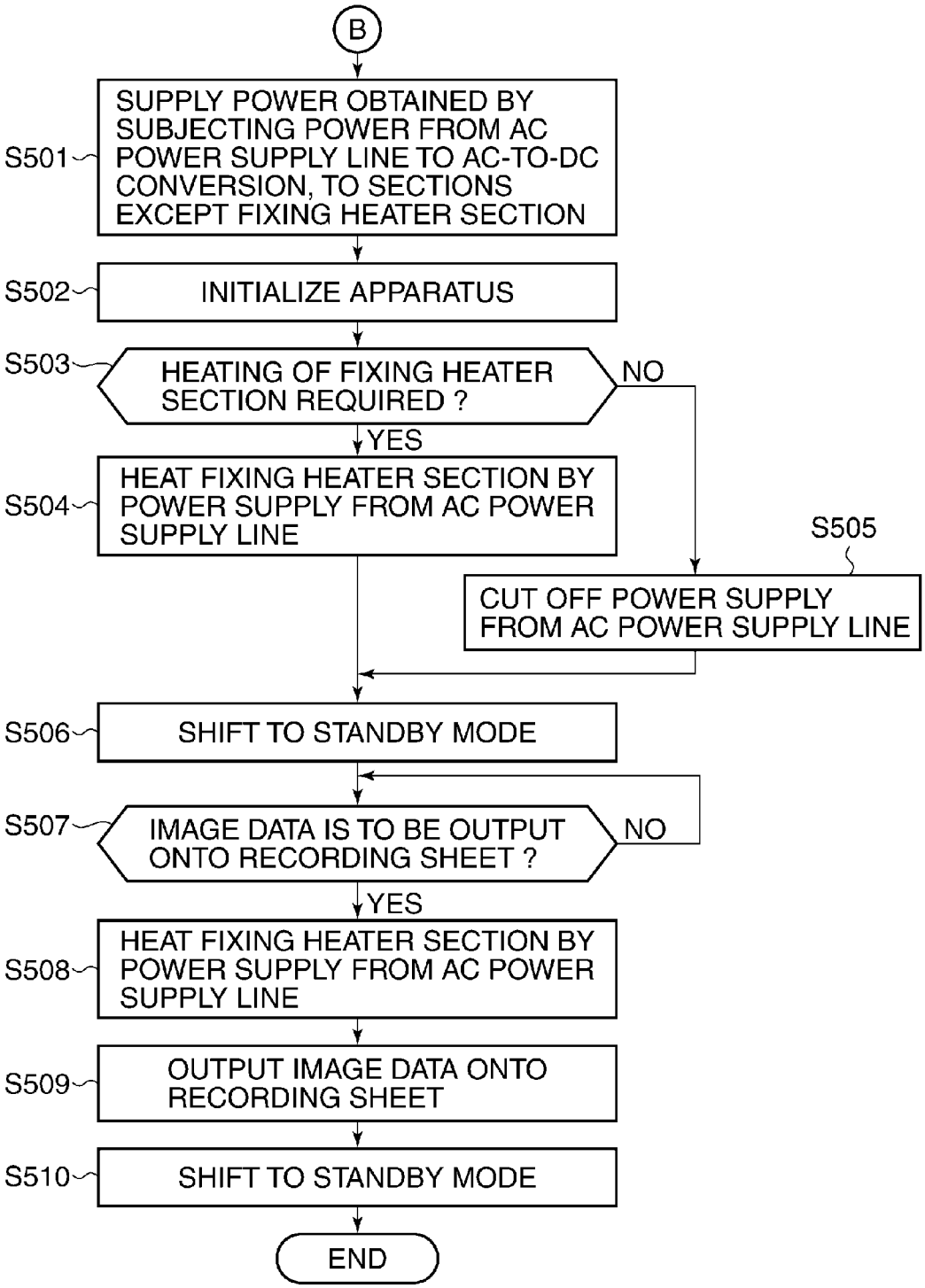
FIG. 5 is a continuation (B) of FIG. 3.

FIG. 5 is a continuation of FIG. 3, i.e. a flowchart of the power supply control process (B) executed by the control section 101 appearing in FIG. 1.

The power supply control process (B) shown in FIG. 5 is a process following the step S304 in FIG. 3, and corresponds to a case where power is supplied from the AC power supply line 1120 alone.

First, power obtained by AC-to-DC conversion of power supplied from the AC power supply line 1120 is supplied to each of the sections except the fixing heater section 1102 (step S501).

Next, the image processing apparatus 100 is initialized (step S502). Then, it is determined whether or not it is required to heat the fixing heater section 1102 (step S503). The answer to the question of this step becomes affirmative (YES) when the current temperature of the fixing heater section 1102 is lower than the predetermined temperature. Otherwise, the answer to the question becomes negative (NO).

If it is determined in the step S503 that it is not required to heat the fixing heater section 1102 (NO to the step S503), supply of power from the AC power supply line 1120 is cut off (step S505), and the process proceeds to a step S506.

On the other hand, if it is determined in the step S503 that it is required to heat the fixing heater section 1102 (YES to the step S503), the fixing heater section 1102 is heated up to the predetermined temperature by power supplied from the AC power supply line 1120 (step S504). Then, the supply of power from the AC power supply line 1120 for heating is cut off, and the image processing apparatus 100 shifts to the standby mode while being supplied with power by the secondary battery 113 (step S506).

Then, when image data is to be output onto a recording sheet (YES to a step S507), the fixing heater section 1102 is heated by power supplied from the AC power supply line 1120 (step S508). As a case where image data is output onto a recording sheet, there may be mentioned the copying operation, the printing operation, or the FAX reception, as described hereinabove.

Then, the image data is output onto the recording sheet (step S509), and the supply of power from the AC power supply line 1120 for heating is cut off. Thereafter, the image processing apparatus 100 shifts to the standby mode while being supplied with power by the secondary battery 113 (step S510), followed by terminating the present process.

Figure 6:
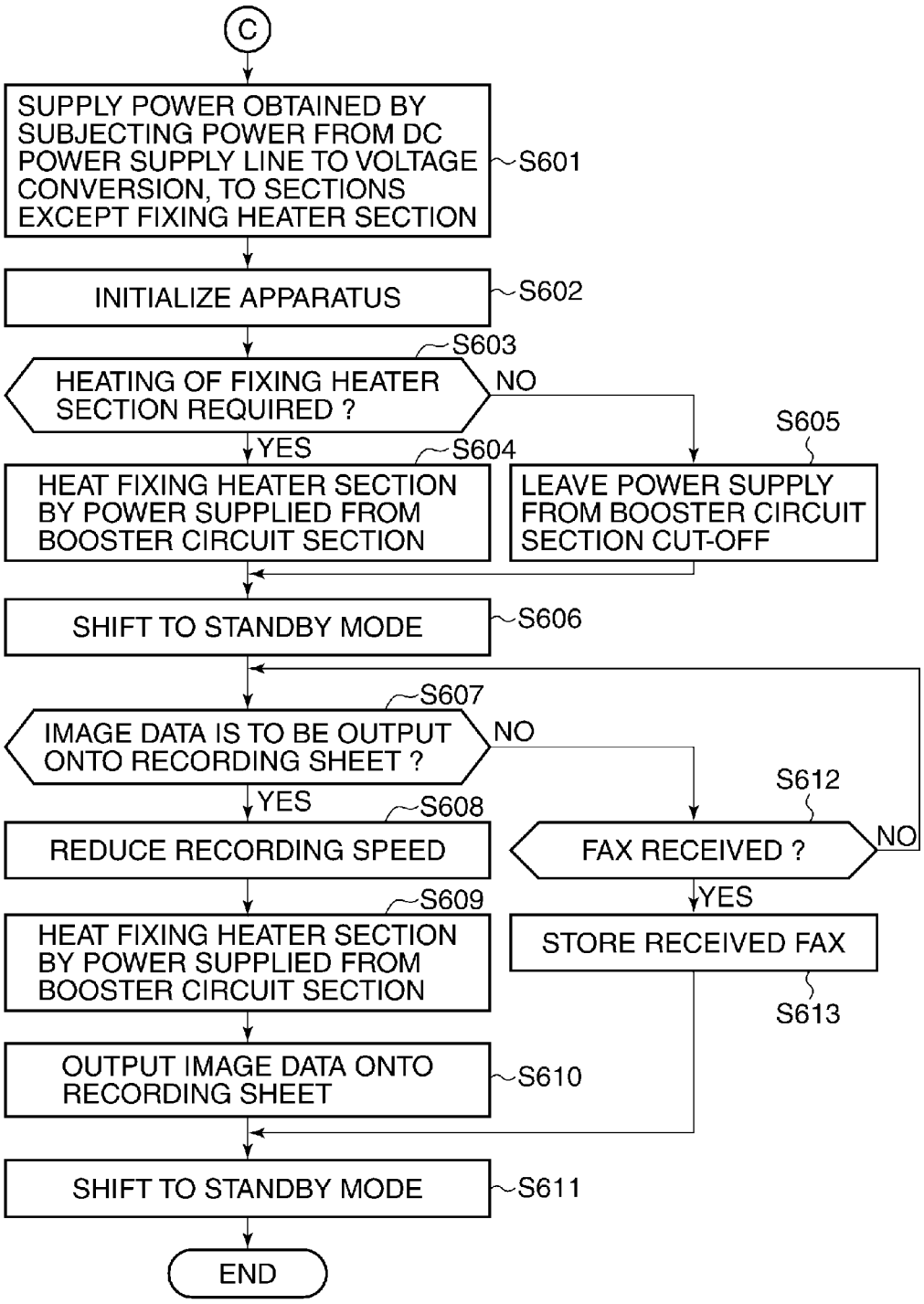
FIG. 6 is a continuation (C) of FIG. 3.

FIG. 6 is a continuation of FIG. 3, i.e. a flowchart of the power supply control process (C) executed by the control section 101 appearing in FIG. 1.

The power supply control process (C) shown in FIG. 6 is a process following the step S305 in FIG. 3, and corresponds to a case where power is supplied from the DC power supply line 1130 alone.

First, power obtained by voltage-conversion of power supplied from the DC power supply line 1130 is supplied to each of the sections except the fixing heater section 1102 (step S601).

Next, the image processing apparatus 100 is initialized (step S602). Then, it is determined whether or not it is required to heat the fixing heater section 1102 (step S603). The answer to the question of this step becomes affirmative (YES) when the current temperature of the fixing heater section 1102 is lower than the predetermined temperature. Otherwise, the answer to the question becomes negative (NO).

If it is determined in the step S603 that it is not required to heat the fixing heater section 1102 (NO to the step S603), the supply of power from the booster circuit section 1303 is left off (step S605), and the process proceeds to a step S606.

On the other hand, if it is determined in the step S603 that it is required to heat the fixing heater section 1102 (YES to the step S603), the fixing heater section 1102 is heated up to the predetermined temperature by power supplied from the booster circuit section 1303 (step S604). Then, the supply of power from the booster circuit section 1303 for heating is cut off, and the image processing apparatus 100 shifts to the standby mode (step S606).

Then, it is determined whether or not image data is to be output onto a recording sheet (step S607). As a case where image data is output onto a recording sheet, there may be mentioned the copying operation or the printing operation.

If it is determined in the step S607 that no image data is to be output onto a recording sheet (NO to the step S607), it is determined whether or not FAX is received (step S612). If it is determined in the step S612 that FAX is not received (NO to the step S612), the process returns to the step S607.

On the other hand, if it is determined in the step S612 that FAX is received (YES to the step S612), FAX received is stored in the RAM 103 by the above-mentioned memory reception function (step S613), and then the process proceeds to a step S611.

If it is determined in the step S607 that image data is to be output onto a recording sheet (YES to the step S607), the image processing apparatus 100 shifts to a low-speed mode which is one of recording modes, whereby recording speed is reduced (step S608). The low-speed mode is a mode in which recording is performed at a lower speed than in the step S407 or S507.

Then, the fixing heater section 1102 is heated by power supplied from the booster circuit section 1303 (step S609).

Then, the image data is output onto the recording sheet (step S610), and the supply of power from the booster circuit section 1303 for heating is cut off. Thereafter, the image processing apparatus 100 shifts to the standby mode (step S611), followed by terminating the present process.

Why DC power is boosted by the booster circuit section 1303 in the step S604 is that the fixing heater section 1102 is configured to use the voltage of AC power supplied from the AC power supply line 1120. The voltage of DC power supplied from the DC power supply line 1130 is lower than that of AC power supplied from the AC power supply line 1120, and therefore, if the voltage of DC power is used without being boosted, voltage and power become insufficient.

Further, in the step S613, since there is no power supply from the AC power supply line 1120, to reduce power consumption, the fixing heater section 1102 is not heated by avoiding output to a recording sheet through the use of the memory reception function. Of course, the fixing heater section 1102 may be heated by power supplied from the booster circuit section 1303 as in the step S609. In this case, recording speed is reduced as in the step S608.

According to the FIG. 6 process, when AC power is not received by the AC power supply circuit section 1301, some functions associated with image processing executed by the image processing apparatus 100 are restricted as shown in the steps S608 and S613.

Specifically, one of the restricted functions is a function for heating a recording sheet by the fixing heater section 1102, as shown in the step S608, and the heating temperature of the fixing heater section 1102 is reduced to a temperature lower than a heating temperature set in the case of heating a recording sheet using AC power. When the function for heating a recording sheet by the fixing heater section 1102 is thus restricted, a time period for heating a recording sheet is set to a time period longer than in a case where AC power is used to heat a recording sheet. The present embodiment is configured such that when the recording speed is reduced, it is possible to set the time period for heating a recording sheet to a time period longer than when AC power is used to heat the recording sheet.

Another of the restricted functions is a FAX reception function for receiving image data by FAX communication and outputting the received image data onto a recording sheet, as shown in the step S613. When the FAX function is restricted, image data received by FAX communication is stored in a storage unit (RAM 103) without being output onto the recording sheet.

Figure 7:
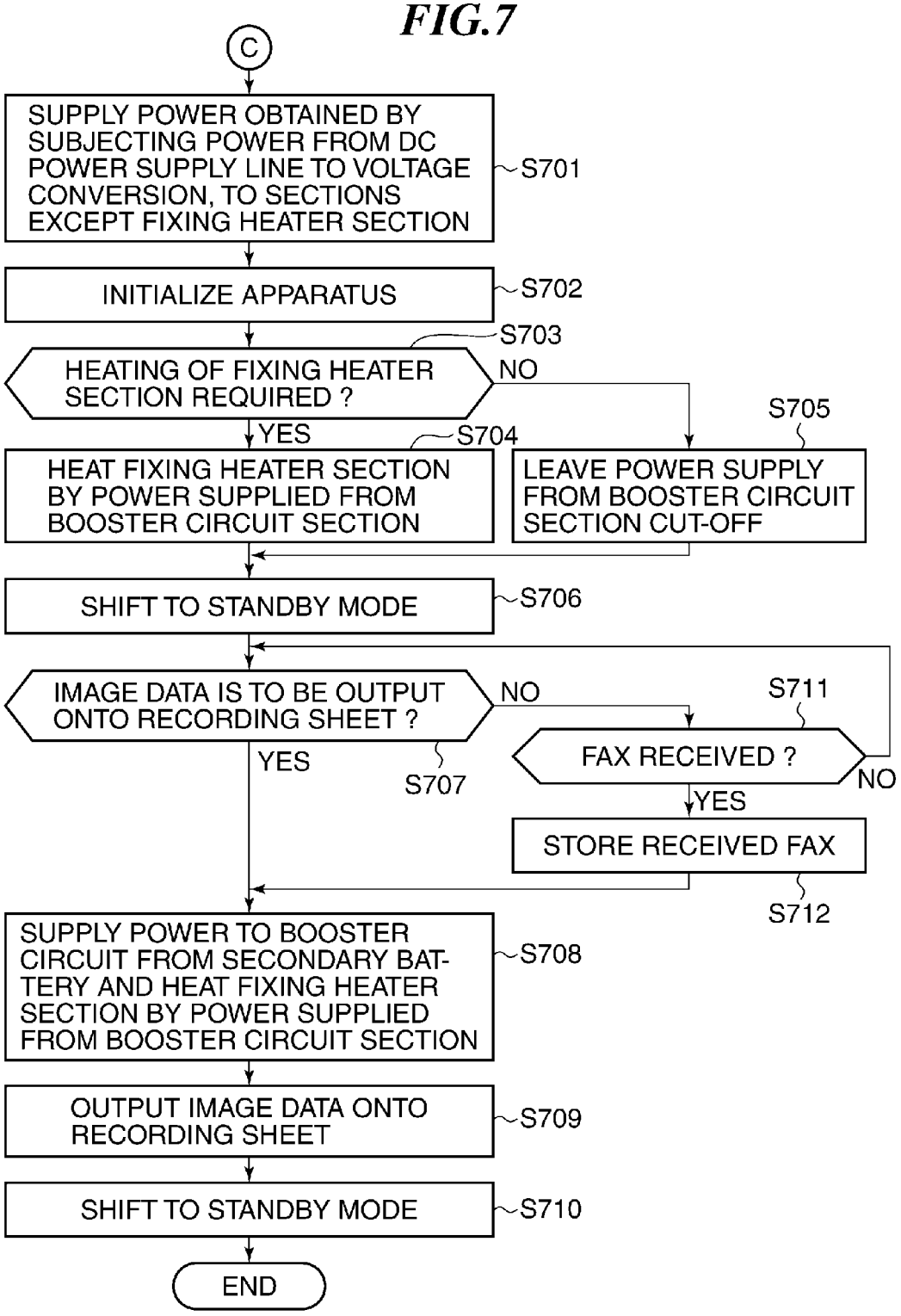
FIG. 7 is a variation of the continuation (C) of FIG. 3.

FIG. 7 is a continuation of FIG. 3, but it is a flowchart of a variation of the power supply control process (C) executed by the control section 101 appearing in FIG. 1.

The power supply control process (C) shown in FIG. 7 is a process following the step S305 in FIG. 3, and corresponds to a case where power is supplied from the DC power supply line 1130 alone.

First, power obtained by voltage conversion of power supplied from the DC power supply line 1130 is supplied to each of the sections except the fixing heater section 1102 (step S701).

Next, the image processing apparatus 100 is initialized (step S702). Then, it is determined whether or not it is required to heat the fixing heater section 1102 (step S703). The answer to the question of this step becomes affirmative (YES) when the current temperature of the fixing heater section 1102 is lower than a predetermined temperature. Otherwise, the answer to the question becomes negative (NO).

If it is determined in the step S703 that it is not required to heat the fixing heater section 1102 (NO to the step S703), the supply of power from the booster circuit section 1303 is left off (step S705), and the process proceeds to a step S706.

On the other hand, if it is determined in the step S703 that it is required to heat the fixing heater section 1102 (YES to the step S703), the fixing heater section 1102 is heated up to the predetermined temperature by power supplied from the booster circuit section 1303 (step S704). Then, the supply of power from the booster circuit section 1303 for heating is cut off, and the image processing apparatus 100 shifts to the standby mode (step S706).

Then, it is determined whether or not image data is to be output onto a recording sheet (step S707). In the step S707, as a case where image data is output onto a recording sheet, there may be mentioned the copying operation or the printing operation.

If it is determined in the step S707 that no image data is to be output onto a recording sheet (NO to the step S707), it is determined whether or not FAX is received (step S711). If it is determined in the step S711 that FAX is not received (NO to the step S711), the process returns to the step S707.

On the other hand, if it is determined in the step S711 that FAX is received (YES to the step S711), FAX received is stored in the RAM 103 by the above-mentioned memory reception function (step S712), and the process proceeds to a step S708.

If it is determined in the step S707 that image data is to be output onto a recording sheet (YES to the step S707), power is supplied to the booster circuit section 1303 from the secondary battery 113, and the fixing heater section 1102 is heated by power from the booster circuit section 1303 (step S708). Therefore, in the step S708, it is possible to add power as auxiliary power from the secondary battery 113 to thereby compensate for an amount of power by which the amount of power that can be supplied from the DC power supply line 1130 is smaller than that of power that can be supplied from the AC power supply line 1120. This makes it possible to maintain power for heating the fixing heater section 1102 at such a level that enables recording to be performed at a normal recording speed, without reduction of recording speed.

Then, the image data is output onto the recording sheet (step S709), and the supply of power from the booster circuit section 1303 for heating is cut off. Thereafter, the image processing apparatus 100 shifts to the standby mode (step S710), followed by terminating the present process. Note that in the step S709, the FAX received by the memory reception function is also output onto a recording sheet.

According to the FIG. 7 process, as shown in the step S708, when AC power is not received by the AC power supply circuit section 1301, power is supplied from the secondary battery 113 in addition to supply of DC power received by the DC power supply circuit section 1302.

In the power control process shown in FIGS. 3 to 7, the state of power supply from each of the AC power supply line 1120 and the DC power supply line 1130 is detected using a turn-on of the power switch of the image processing apparatus 100 as a trigger. However, the power supply states may be detected not only when the power switch is turned on, but also during operation of the image processing apparatus 100.

In this case, the operation flow is dynamically switched under the control of the control section 101 based on a result of detection as to whether or not power is being supplied from each of the AC power supply line 1120 and the DC power supply line 1130.

Whether or not power is being supplied from each of the AC power supply line 1120 and the DC power supply line 1130 is detected also during operation of the image processing apparatus 100, as performed in the step S302. Then, when power is being supplied from both the AC power supply line 1120 and the DC power supply line 1130, power from the DC power supply line 1130 is subjected to voltage conversion and supplied to the control section 101, whereafter the process proceeds to the step S406 in FIG. 4.

When power is being supplied from the AC power supply line 1120 alone, power from the AC power supply line 1120 is subjected to AC-to-DC conversion and then supplied to the control section 101, whereafter the process proceeds to the step S506 in FIG. 5.

When power is being supplied from the DC power supply line 1130 alone, power from the DC power supply line 1130 is subjected to voltage conversion and supplied to the control section 101, whereafter the process proceeds to the step S606 in FIG. 6 or the step S706 in FIG. 7.

Aspects of the present invention can also be realized by a computer of a system or apparatus (or devices such as a CPU or MPU) that reads out and executes a program recorded on a memory device to perform the functions of the above-described embodiment, and by a method, the steps of which are performed by a computer of a system or apparatus by, for example, reading out and executing a program recorded on a memory device to perform the functions of the above-described embodiment. For this purpose, the program is provided to the computer for example via a network or from a recording medium of various types serving as the memory device (e.g., computer-readable medium).

While the present invention has been described with reference to an exemplary embodiment, it is to be understood that the invention is not limited to the disclosed exemplary embodiment. The scope of the following claims is to be accorded the broadest interpretation so as to encompass all such modifications and equivalent structures and functions.

This application claims priority from Japanese Patent Application No. 2012-050281 filed Mar. 7, 2012, which is hereby incorporated by reference herein in its entirety.

What is claimed is:

1. An image processing apparatus including a heating unit for heating a recording sheet having toner transferred thereon so as to fuse the toner onto the sheet, and a plurality of electronic circuits, comprising:

an AC power receiving unit configured to receive AC power from an AC power supply;

a DC power receiving unit configured to receive DC power from a DC power supply; and a supply unit configured to supply the AC power received by said AC power receiving unit to the heating unit, and the DC power received by said DC power receiving unit to the plurality of electronic circuits, wherein when AC power is not received by said AC power receiving unit, some of functions associated with image processing performed by the image processing apparatus are restricted.

2. The image processing apparatus according to claim 1, wherein when heating by the heating unit is not to be performed, said supply unit does not supply the AC power received by said AC power receiving unit.

3. The image processing apparatus according to claim 1, wherein one of the restricted functions is a function for heating the recording sheet by the heating unit.

4. The image processing apparatus according to claim 3, wherein when the function for heating the recording sheet by the heating unit is restricted, a time period for heating the recording sheet is set to a longer time period than in the case where AC power is used for heating.

5. The image processing apparatus according to claim 1, further comprising a storage unit configured to store image data, and wherein one of the restricted functions is a FAX reception function for receiving image data by FAX communication and outputting the received image data onto the recording sheet, and when the FAX reception function is restricted, the image data received by the FAX communication is stored in said storage unit without being output onto the recording sheet.

6. The image processing apparatus according to claim 1, further comprising a power storage unit capable of storing power, and wherein when AC power is not received by said AC power receiving unit, power is supplied from said power storage unit in addition to supply of DC power received by said DC power receiving unit.

7. The image processing apparatus according to claim 1, wherein the AC power supply is external to the image processing apparatus, the DC power supply is external to the image processing apparatus, and the AC power supply and the DC power supply are different power supplies from each other.

8. The image processing apparatus according to claim 1, wherein the DC power receiving unit is configured to receive unconverted DC power from the DC power supply.

9. A method of controlling an image processing apparatus including a heating unit for heating a recording sheet having toner transferred thereon so as to fuse the toner onto the sheet, and a plurality of electronic circuits, comprising:

receiving AC power from an AC power supply;

receiving DC power from a DC power supply; and supplying the AC power received from the AC power supply to the heating unit, and the DC power received from the DC power supply to the plurality of electronic circuits, wherein when AC power is not received from the AC power supply, some of functions associated with image processing performed by the image processing apparatus are restricted.

10. A non-transitory computer-readable storage medium storing a computer-executable program for causing a computer to execute a method of controlling an image processing apparatus including a heating unit for heating a recording sheet having toner transferred thereon so as to fuse the toner onto the sheet, and a plurality of electronic circuits, wherein the method comprises:

receiving AC power from an AC power supply;

receiving DC power from a DC power supply; and supplying the AC power received from the AC power supply to the heating unit, and the DC power received from the DC power supply to the plurality of electronic circuits, wherein when AC power is not received from the AC power supply, some of functions associated with image processing performed by the image processing apparatus are restricted.

* * * * *